US009142383B2

(12) United States Patent
Zhou et al.

(10) Patent No.: US 9,142,383 B2
(45) Date of Patent: Sep. 22, 2015

(54) DEVICE AND METHOD FOR MONITORING X-RAY GENERATION

(75) Inventors: Zilu Zhou, Needham, MA (US); Joel Lee Groves, Leonia, NJ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 383 days.

(21) Appl. No.: 13/460,476

(22) Filed: Apr. 30, 2012

(65) Prior Publication Data

US 2013/0287174 A1 Oct. 31, 2013

(51) Int. Cl.
*H05G 1/30* (2006.01)
*H01J 35/08* (2006.01)

(52) U.S. Cl.
CPC ..... *H01J 35/08* (2013.01); *H01J 2235/086* (2013.01)

(58) Field of Classification Search
CPC ..... H01J 2235/1204
See application file for complete search history.

(56) References Cited

U.S. PATENT DOCUMENTS

| | | | | |
|---|---|---|---|---|
| 6,463,123 | B1 | 10/2002 | Korenev | |
| 6,907,106 | B1 | 6/2005 | McIntyre et al. | |
| 7,960,687 | B1 | 6/2011 | Simon et al. | |
| 7,991,111 | B2 | 8/2011 | Wraight et al. | |
| 2007/0248214 | A1 | 10/2007 | Smith | |
| 2009/0057545 | A1 | 3/2009 | Saenger et al. | |
| 2009/0219028 | A1 | 9/2009 | Perkins et al. | |
| 2011/0002443 | A1 | 1/2011 | Wraight et al. | |
| 2012/0081042 | A1* | 4/2012 | Cheung et al. | 315/505 |
| 2012/0175510 | A1 | 7/2012 | Zhou et al. | |

FOREIGN PATENT DOCUMENTS

EP 436983 7/1991

OTHER PUBLICATIONS

Adam et al., "Radiation Hard Diamond Sensors for Future Tracking Applications," Nuclear Instruments and Methods in Physics Research A, 2006, vol. 565: pp. 278-283.
Berger et al., "NISTIR 4999: Stopping-Power and Range Tables for Electrons, Protons, and Helium Ions," The National Institute of Standards and Technology, 2009: pp. 1-10.
Ciobanu et al., "In-Beam Diamond Start Detectors," IEEE Transactions on Nuclear Science, 2011: pp. 1-11.
Knoll, "II. Semiconductor Materials Other Than Silicon or Germanium," Radiation Detection and Measurement, Third Edition, John Wiley & Sons, Inc.: New Jersey, 2000: pp. 477-489.
Pomorski et al., "Development of Single-Crystal CVD-Diamond Detectors for Spectroscopy and Timing," Phys. Stat. Sol. (a), 2006, vol. 203(12): pp. 3152-3160.
Segré, "Chapter 3: Detection Methods for Nuclear Radiations," Nuclei and Particles, Second Edition, The Benjamin/Cummings Publishing Company, Inc.: Massachusetts, 1977: pp. 86-94.
U.S. Appl. No. 13/338,702, entitled, "Device and Method for Ion Generation," filed Dec. 28, 2011: pp. 1-26.

* cited by examiner

*Primary Examiner* — Hoon Song

(57) ABSTRACT

Illustrative embodiments of the present disclosure are directed to devices and methods for X-ray monitoring. Various embodiments of the present disclosure use a target that incorporates a monitor layer. The monitor layer is disposed adjacent to a target layer so that electrons that pass through the target layer enter the monitor layer. As electrons enter the monitor layer, electrical charge is generated within the monitor layer. This electrical charge is measured and used to determine a characteristic of the X-ray generation within the target layer.

25 Claims, 13 Drawing Sheets

DEVICE AND METHOD FOR MONITORING X-RAY GENERATION

TECHNICAL FIELD

This disclosure relates to X-ray generation, and more particularly to devices and methods that use an electron beam to generate X-rays.

BACKGROUND

X-rays are used in oil and gas field tools for a variety of different applications. In one example, X-rays are used to evaluate a substance, such as a fluid or a formation. To this end, an X-ray generator is used to generate X-rays that pass through the substance. X-ray output of the X-ray generator is measured by a reference detector, while the X-rays that pass through the substance are measured by a second X-ray detector. The resulting signals from the reference detector and the second detector can be used to determine substance characteristics, such as density, porosity, and/or photo-electric effect.

In conventional systems, the reference detector uses a scintillator material to detect the X-rays. As the X-rays impact the scintillator material, the scintillator emits photons. In turn, the photons are detected by a photon detector, such as a photo multiplier tube (PMT). In this manner, a signal representative of the output X-rays is generated.

Such conventional reference detectors are difficult to use in oil and gas field tools. For example, one design constraint is that the reference detector is often placed immediately adjacent to the X-ray generator in order to more accurately measure output X-rays. Furthermore, to protect the reference detector from background and scattered X-rays, the reference detector is protected using a shielding material, which increases the package size of the reference detector. Such additional spacing and design constrains are particularly disadvantageous in downhole tools where available space is scarce. Also, the performance of scintillator detectors deteriorates as temperature fluctuates. This problem is compounded in downhole applications where environmental temperatures can be dynamic.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Illustrative embodiments of the present disclosure are directed to devices and methods for X-ray monitoring. Various embodiments of the present disclosure use a target that incorporates a monitor layer. The monitor layer is disposed adjacent to a target layer so that electrons that pass through the target layer enter the monitor layer. As electrons enter the monitor layer, electrical charge is generated within the monitor layer. This electrical charge is measured and used to determine a characteristic of the X-ray generation within the target layer.

Illustrative embodiments of the present disclosure are directed to a target for generating X-rays. The target includes a target layer that generates X-rays when electrons enter the target layer. The target layer has a thickness selected so that at least some electrons pass through the target layer. The target also includes a monitor layer disposed adjacent to the target layer so that at least some of the electrons that pass through the target layer enter the at least one monitor layer. In various embodiments, the target includes two monitor layers. In yet further embodiments, the target includes more than two layers.

Illustrative embodiments of the present disclosure are directed to a device for generating X-rays. The device includes an electron source for generating electrons, an accelerator section for generating an electron beam, and a target. The target includes a target layer that generates X-rays when electrons enter the target layer. The target layer has a thickness selected so that at least some electrons pass through the target layer. The target also includes a monitor layer disposed adjacent to the target layer so that at least some of the electrons that pass through the target layer enter the at least one monitor layer. In various embodiments, the target includes two monitor layers. In yet further embodiments, the target includes more than two layers.

Illustrative embodiments of the present disclosure are directed to a method for monitoring X-ray generation. The method includes generating electrons and accelerating the electrons towards a target to generate X-rays. At least some of the electrons pass through the target and enter a monitor. The method further includes measuring an electric parameter produced by the electrons within the monitor and generating an output signal characterizing the electric parameter.

BRIEF DESCRIPTION OF THE DRAWINGS

Those skilled in the art should more fully appreciate advantages of various embodiments of the disclosure from the following "Description of Illustrative Embodiments," discussed with reference to the drawings summarized immediately below.

DESCRIPTION OF ILLUSTRATIVE EMBODIMENTS

Illustrative embodiments of the present disclosure are directed to devices and methods for X-ray monitoring. Various embodiments of the present disclosure use a target that incorporates a monitor layer. The monitor layer is disposed adjacent to a target layer so that electrons that pass through the target layer enter the monitor layer. As electrons enter the monitor layer, electrical charge is generated within the monitor layer. This electrical charge is measured and used to determine a characteristic of the X-ray generation within the target layer. In this manner, various embodiments of the present disclosure consume less space and function more reliably in dynamic temperature environments than conventional reference detectors. Details of various embodiments are discussed below.

Figure 1:
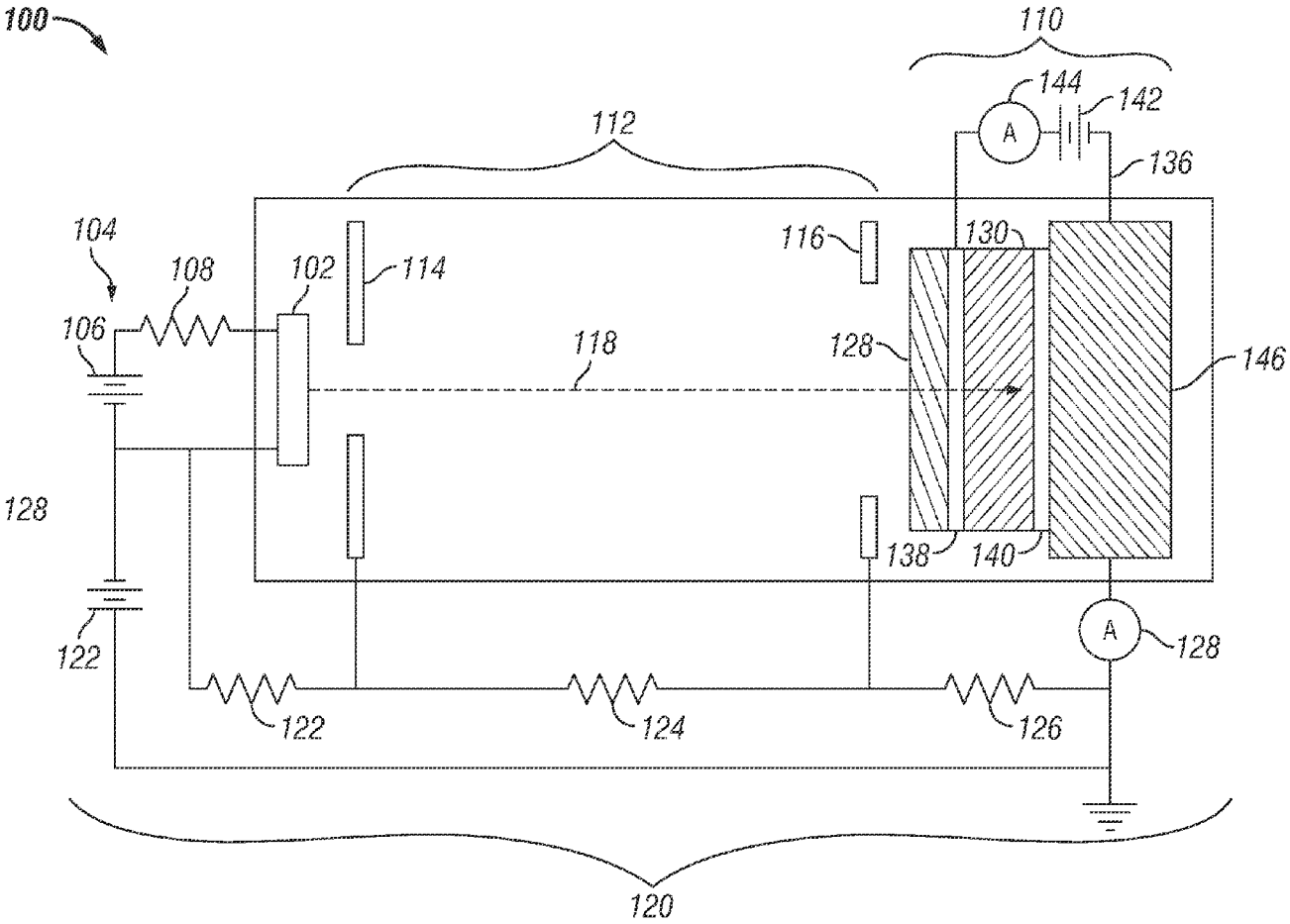
FIG. 1 shows an X-ray generator in accordance with one embodiment of the present disclosure.

FIG. 1 shows an X-ray generator 100 in accordance with one embodiment of the present disclosure. The X-ray generator 100 includes an electron source 102 configured to generate electrons. In one embodiment, the electron source 102 is a heated filament (e.g., "hot cathode") that releases electrons when the filament reaches a certain temperature. In various embodiments, the heated filament is made from materials such as tungsten, barium, yttria, and $LaB_6$. In additional or alternative embodiments, the electron source 102 includes a substrate with a plurality of nano-tips disposed on the substrate. When an appropriate electrical potential is applied to the nano-tips, the nano-tips release electrons. Further details of such configurations are provided in U.S. patent application Ser. No. 13/338,702, filed on Dec. 28, 2011. This application is hereby incorporated by reference in its entirety.

The electron source 102 is connected to control circuitry 104 that provides the electron source with electrical power. As shown in FIG. 1, in various embodiments, the control circuitry 104 may include a power supply 106 and a first resistor 108. In embodiments that use a heated filament, the power supply 106 may provide the electron source 102 with between 1V and 20V.

The electrons that are generated by the electron source 102 are accelerated at a target 110 using an accelerator section 112. The accelerator section 112 forms an electron beam that strikes the target 110. In the exemplary embodiment shown in FIG. 1, the accelerator section 112 includes a first grid 114 and a second grid 116. Both the first grid 114 and the second grid 116 are set to positive potentials, relative to the electron source 102. The second grid 116 is set at a greater positive potential than the first grid 114. In this manner, the electrons generated by the electron source 102 are pushed/pulled away from the electron source and accelerated towards the target 110. The arrow 118 within FIG. 1 shows the direction of the accelerated electrons. In some embodiments, the accelerator section 112 can also include collimators, deflecting and focusing electrodes, bending and focusing magnets, and/or accelerating RF cavities (not shown) for further shaping and accelerating the electron beam.

In some embodiments, that use a plurality of nano-tips, the power supply 106 is not used. Instead, the positive potential that is applied to the first grid 114 provides an electric field (e.g., between 2 MV to 10 MV per meter) that is sufficient to power the electron source 102.

The first grid 114 and second grid 116 are configured to create electrical potentials across certain areas within the accelerator section 112. To this end, in one example, the grids are composed from a plurality of conductive wires that form a two-dimensional pattern (e.g., a mesh or netted material). In additional or alternative embodiments, the grids are conductive plates and/or electrodes. Furthermore, as shown in FIG. 1 the accelerator section uses two grids. In various other illustrative embodiments, only a single grid is used or more than two grids can be used (e.g., 3, 5, 10 grids).

The accelerator section 112 is connected to power circuitry 120 that provides the accelerator section with electrical power. As shown in FIG. 1, in various embodiments, the power circuitry 120 may include a power supply 122 that is in electrical communication with the first grid 114 and the second grid 116. In further illustrative embodiments, the power circuitry 120 can also be in communication with other components such as the target 110 and the electron source 102. The power supply 122 supplies the electrical potential to at least some of the components (e.g., first grid 114, second grid 116, and target 110). In various embodiments, the power supply 122 operates the accelerator section 112 in a pulsed mode of operation and/or a DC mode of operation. In some embodiments, the power circuitry 120 includes a series of resistors 122, 124, 126 that modulate the electrical potential applied to the components. For example, a second resistor 124 is used between the first grid 114 and the second grid 116 to modulate the electrical potential applied between the two grids. In further illustrative embodiments, the power circuitry 120 includes an amp-meter 128 for measuring the electron beam current.

In various embodiments of the present disclosure, the target 110 and the electron source 102 are separated from each other by a distance of between 5 centimeters to 5 meters. The power circuitry 120 generates a difference of electrical potential between the electron source 102 and the target 110 between 100 kV and 10 MV (e.g., difference in electrical potential between first grid 114 and second grid 116). In this manner, illustrative embodiments of the acceleration section 112 are configured to generate electron beams with energies of at least 100 keV. Illustrative embodiments of the present disclosure have application to X-ray generators that use electron beams with energies in the range of 100 keV to 10 MeV.

FIG. 1 also shows the target 110 in accordance with one embodiment of the present disclosure. The target includes a target layer 128 and a monitor layer 130. The target layer 128 is configured to generate X-rays when electrons enter the target layer. To this end, the target layer 128 can be formed form a material such as gold, platinum, tungsten, or any other conductive metal element with a high atomic Z number. When the electrons impact the target layer 128 and move through the target layer, at least some of the electrons generate X-rays (e.g., Bremsstrahlung). In accordance with various embodiments disclosed herein, the target layer 128 can also be selected to have a thickness so that at least some of the electrons pass through the target layer. In various embodiments, most of the electrons pass through the target layer.

Figure 2:
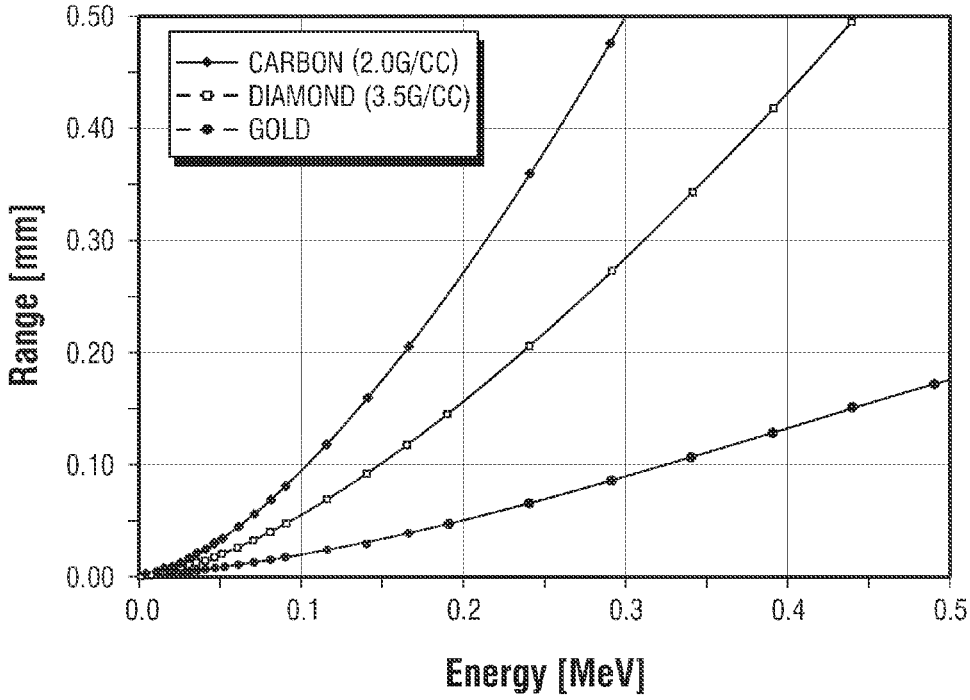
FIG. 2 shows a plot of penetration range versus electron energy in accordance with one embodiment of the present disclosure.

FIG. 2 shows a plot of penetration range versus electron energy in accordance with one embodiment of the present disclosure. In particular, the plot shows the penetration range within diamond, gold, and carbon for a number of different electron energies. The thickness of the target layer 128 can be selected according to the plot for gold shown in FIG. 2. For example, if the accelerator section 112 is generating electrons with energy of 0.35 Mev, then a gold target layer is selected to have a thickness less than 0.10 mm so that at least some electrons pass through the target layer. In some embodiments, the surface area of the target layer is between 1 $mm^2$ and a 5 $cm^2$ to cover the actual beam spot size in the designed system.

Figure 3:
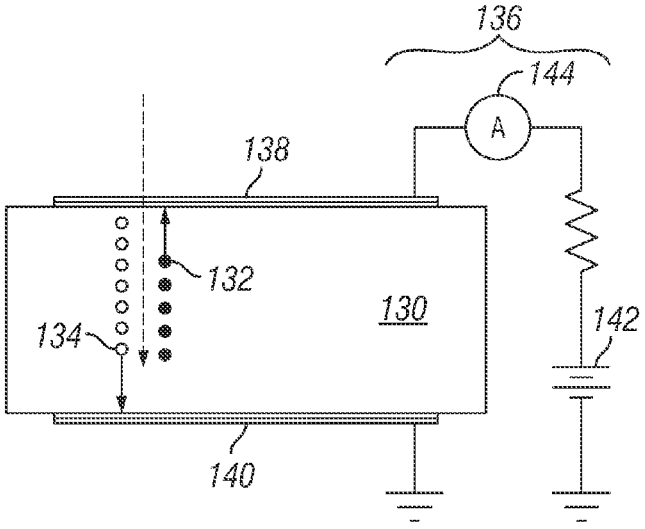
FIG. 3 shows an electron entering a monitor layer in accordance with one embodiment of the present disclosure.

When the electron beam strikes the target, the electrons will lose their energy within the target layer 128. If the target layer is selected appropriately, most electrons will pass through the target layer 128 and enter into the monitor layer 130 with a residual energy. FIG. 3 shows an electron entering the monitor layer 130 in accordance with one embodiment of the present disclosure. As the electron passes through the monitor layer 130, the electron produces secondary ionization charges within the monitor layer (e.g., electrons 132 and "holes" 134). These charges produce a current and the current is measured by measuring circuitry that is electrically coupled to the monitor layer 136. To this end, as shown in FIGS. 1 and 3, the monitor layer 130 is disposed between a first conductive layer 138 and a second conductive layer 140. The first conductive layer 138 and the second conductive layer 140 are electrical contacts for coupling the monitor layer 130 to the measuring circuitry 136. In various embodiments, the conductive layers can be formed from a conductive metal or material (e.g., copper, aluminum, chromium, nickel, gold, or platinum) or a plurality of layers formed from different conductive metals or materials. In further illustrative embodiments, the layer or plurality of layers have a thickness of between 50 nm and 500 nm. In one specific example, the conductive layers are applied to the monitor layer using a metallization process such as chemical vapor deposition.

The measuring circuitry 136 also includes a power supply 142 for applying an electrical potential to the first conducting layer 138 and/or the second conducting layer 140 (e.g., a voltage bias). In the specific example of FIG. 3, the power supply 142 applies a positive potential to the first conductive layer 138 and a negative potential to the second conductive layer 140. In this manner, electrons 132 produced within the monitor layer 130 are collected at the first conductive layer 138, while "holes" 134 are collected at the second conductive layer 140. In various embodiments, the voltage bias is in a range of 10V-5 kV depending on the thickness and material of the monitor layer 130. In a more specific embodiment, the voltage bias is in a range of 0.1 V/μm to 10 V/μm.

The measuring circuitry 136 includes a meter 144 for measuring current for measuring the current generated by the monitor layer 130. In the specific examples of FIGS. 1 and 3, the meter 144 is an amp-meter for measuring the current produced within the monitor layer 130 and producing an output signal characterizing the current (e.g., a read-out current). Additionally or alternatively, the measuring circuitry 136 can also include other meters to measure other electrical parameters generated by the monitor layer 130 (e.g., charge, current, voltage, resistance, or impedance). Such meters also generate an output signal characterizing the electrical parameter. In further illustrative embodiments, the measuring circuitry 136 can also include an amplifier for amplifying an electrical parameter that is generated when electrons enter the monitor layer.

In various embodiments of the present disclosure, the monitor layer 130 is formed from a solid-state material such as silicon, silicon carbide, and diamond. In further illustrative embodiments, the monitor layer is formed from a large band-gap material such as a diamond. In one specific embodiment, the monitor layer 130 is formed from a poly-diamond material that is produced through a chemical vapor deposition process. In another illustrative embodiment, the monitor layer 130 is formed from a single crystal diamond material. A pure single crystal diamond layer with a size of 5×5×0.5 mm can be acquired from Diamond Detector Ltd., which is a company located in the United Kingdom.

Large band-gap materials provide for improved performance over a broad range of temperatures. Furthermore, large band-gap materials, such as diamond, have a high thermal conductivity and can withstand heat produced by the target layer (e.g., diamond has a thermal conductivity of 20 W/cm/° C.). Such large-band gap materials can be advantageously used in downhole applications where ambient temperatures often exceed 150° C. In contrast, conventional reference detectors use scintillator materials. Often times, performance of scintillator materials is inconsistent in dynamic temperature environments and degrades substantially at high temperatures. Table 1 shows several monitor layer materials in accordance with exemplary embodiments of the present disclosure.

TABLE 1

| | Silicon | Silicon-carbide | Diamond |
|---|---|---|---|
| Band gap (eV) | 1.11 | 2.86 | 5.45 |
| Density ($g/cm^3$) | 2.33 | 3.22 | 3.51 |

In some embodiments, the monitor layer 130 is selected to dissipate electron energy so that electrons are prevented from passing through the monitor layer (e.g. prevented from penetrating the entire monitor layer). To this end, the thickness of the monitor layer 130 can be selected according to the plot for diamond shown in FIG. 2. For example, if, after passing through the target layer 128, the electrons have a residual energy of 0.1 Mev, then a carbon monitor layer 130 is selected with a thickness greater than 0.10 mm so that electrons are prevented from passing through the monitor layer. The surface area of the monitor layer 130 can be between 1 $mm^2$ and a 5 $cm^2$ to cover the actual beam spot size in the designed system.

Illustrative embodiments of the target 110 also include a heat sink 146 that is thermally coupled to the target layer 128 and/or the monitor layer 130. As the electron beam strikes the target 110, thermal energy is generated within the target layer 128 and the monitor layer 130. The heat sink 146 conducts thermal energy away from the target layer 128 and monitor layer 130. The heat sink 146 can be formed from a thermally conductive material such as copper or aluminum. In some embodiments, as shown in FIG. 1, the heat sink 146 is also electrically coupled to power circuitry 120. The power circuitry 120 applies an electrical potential to the heat sink 146 and further facilitates acceleration of the electron beam towards the target 110.

Illustrative embodiments of the present disclosure advantageously monitor generation of X-rays without significantly impairing X-ray generation. In other words, the thickness of the target layer 128 is selected to dissipate electron energy so that the majority of electrons that exit the target layer lack sufficient residual energy to generate a useful amount of X-rays within the target layer. To this end, in various embodiments, the material composition and thickness of the target layer 128 are selected to allow electrons to pass, while also maintaining efficiency of X-ray production.

In one specific example, the X-ray generator 100 produces an electron beam with 500 keV. The target 110 includes a gold target layer 128 with a thickness of approximately 140 μm. A gold target layer 128 with such a thickness dissipates the energy of the electron beam from 500 keV to approximately 150 keV. In doing so, X-rays are generated within the target layer 128. The remaining electrons at 150 keV cannot produce significantly more useful X-rays within the target layer 128, but these remaining electrons have sufficient energy to enter the monitor layer 130 and produce charges within the monitor layer that can be measured. In turn, the monitor layer 130 can be selected to prevent substantially all of the electrons from passing through the monitor layer. To this end, a carbon layer 130 with a thickness of more than 160 μm will stop the remaining electrons. Additionally or alternatively, a diamond monitor layer 130 with a thickness of more than 100 μm will stop the remaining electrons.

Figure 4:
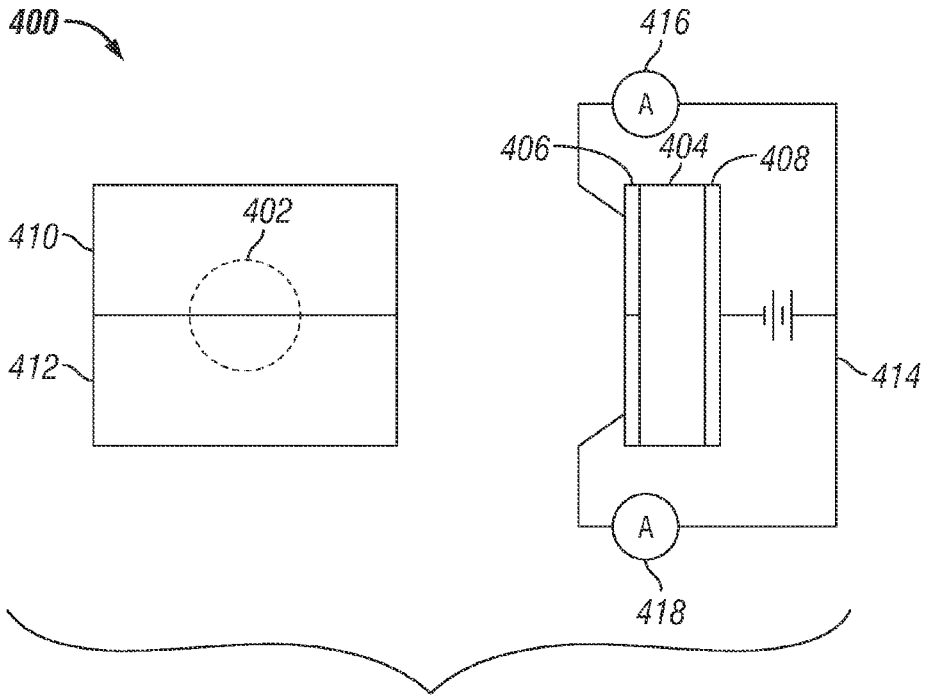
FIG. 4 shows a target that monitors electron beam position in accordance with one embodiment of the present disclosure.

Illustrative embodiments of the present disclosure are also directed to a target that can monitor an electron beam spot profile. FIG. 4 shows a target 400 that monitors a position of a beam spot profile 402 in accordance with one embodiment of the present disclosure. The target 400 includes a monitor layer 404 that is disposed between a first conducting layer 406 and a second conducting layer 408. In this case, the first conducting layer 406 is split into two sections: a first half 410 and a second half 412. In additional or alternative embodiments, the second conductive layer 408 is split into a plurality of sections (e.g., first half and second half). In some embodiments, both the first conductive layer 406 and the second conductive layer 408 are split into a plurality of sections. In further illustrative embodiments, the sections 410, 412 are insulated from one another by, for example, depositing an insulator between the sections or by creating a space between the sections. The target 400 also includes measuring circuitry 414 that includes a first amp-meter 416 coupled to the first half 410 and a second amp-meter 418 coupled to the second half 412. The first amp-meter 416 measures current produced within the first section 410 of the monitor layer 404 and the second amp-meter 418 measures current produced within the second section 412 of the monitor layer. The position of the spot profile 402 is monitored by interpreting the read-out currents from the first section 410 and the second section 412.

In one specific embodiment, the sections 410, 412 are arranged so that an electron beam impacts the target 414 and generates a spot profile 402 that is centered between the first section and the second section. When the spot profile 402 is centered between the two sections 410, 412, read-out currents at the amp-meters 416, 418 are approximately equal. The measuring circuitry 414 can detect a vertical change in position of the spot profile 402 by detecting an increase or decrease within the read-out current of the sections 410, 412. In one specific example, if the spot profile 402 moves up from the centered position, then the first amp-meter 416 detects an increase in read-out current while the second amp-meter 418 detects a decrease in read-out current. In another specific example, if the spot beam 402 is centered, but the strength of the electron beam has decreased, then the read-out currents in both sections 410, 412 decrease proportionally.

Figure 5:
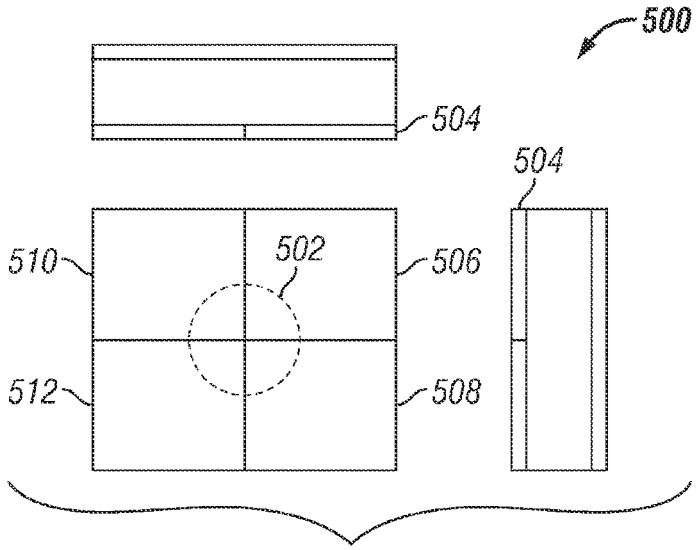
FIG. 5 shows another target that monitors electron beam position in accordance with one embodiment of the present disclosure.

FIG. 5 shows another target 500 that monitors a position of a beam spot profile 502 in accordance with one embodiment of the present disclosure. In the embodiment of FIG. 5, a first conducting layer 504 is split into four sections (e.g., quadrants) 506, 508, 510, 512. Measuring circuitry with four amp-meters (not shown) is coupled to the four sections 506, 508, 510, 512. The position of the spot profile 502 is monitored by interpreting the read-out currents from the four different sections. In such an embodiment, the measuring circuitry can detect change in position of the spot profile 502 in a plurality of different directions (e.g., vertical, horizontal, or diagonal).

Figure 6:
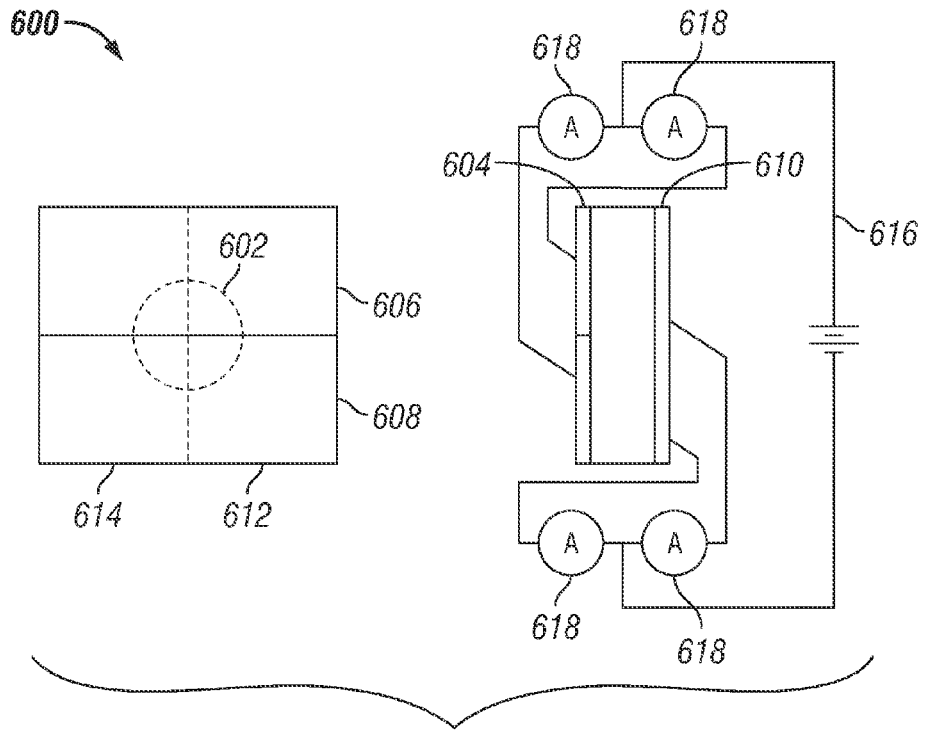
FIG. 6 shows yet another target that monitors electron beam position in accordance with one embodiment of the present disclosure.

FIG. 6 shows yet another target 600 that monitors a position of a beam spot profile 602 in accordance with one embodiment of the present disclosure. In FIG. 6, a first conducting layer 604 is split into two sections: a first horizontal strip 606 and a second horizontal strip 608, while a second conducting layer 610 is also split into two sections: a first vertical strip 612 and a second vertical strip 614. Measuring circuitry 616 includes four amp-meters 618 that are coupled to the four different strips 606, 608, 612 614. In such an embodiment, the measuring circuitry 616 can detect change in position of the spot profile 602 in a plurality of different directions (e.g., vertical, horizontal, or diagonal) by detecting a change in read-out current at one of the amp-meters 618.

Figure 7:
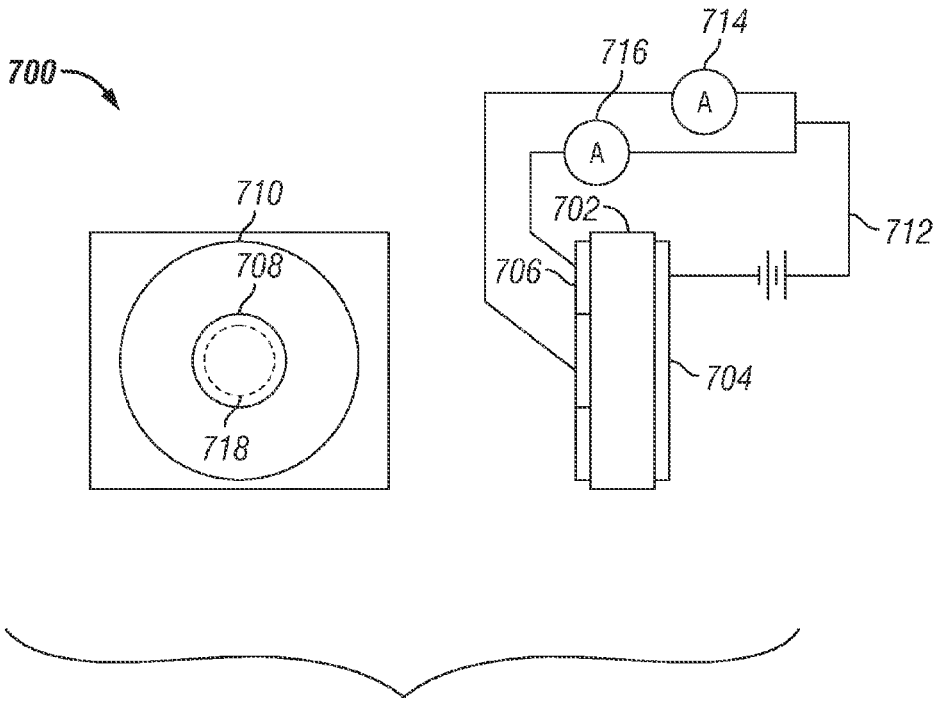
FIG. 7 shows a target that monitors spot profile size and position in accordance with one embodiment of the present disclosure.

FIG. 7 shows a target 700 that monitors beam spot profile size and position in accordance with one embodiment of the present disclosure. The target 700 includes a monitor layer 702 that is disposed between a first conducting layer 704 and a second conducting layer 706. In this case, the first conducting layer 704 is split into two concentric sections that are insulated from one another: a central section 708 and a periphery section 710. In various embodiments, the concentric sections can be circles, squares, or rectangles. The target 700 also includes measuring circuitry 712 that includes a first amp-meter 714 coupled to the central section 708 and a second amp-meter 716 coupled to the periphery section 710. The first amp-meter 714 measures current produced within the central section 708 of the monitor layer 702 and the second amp-meter 716 measures current produced within the periphery section 710 of the monitor layer. The position and size of the spot profile 718 is monitored by interpreting the read-out currents from the central section 708 and the periphery section 710.

In one specific embodiment, the central section 708 and the periphery section 710 are arranged and sized so that the electron beam generates a spot profile 718 that appears only within the central section of the monitor layer 702. In such an embodiment, the read-out current for the central section 708 would be significant, while the read out current for the periphery section 710 would be much smaller (e.g., insignificant). The measuring circuitry 712 can detect a change in position of the spot profile 718 or a change in size of the spot profile by detecting an increase or decrease within the read-out current for the central section 708 and/or the periphery section 710. In one specific example, if the spot profile 708 expanded in size, then the first amp-meter 714 would detect a decrease in read-out current and the second amp-meter 716 would detect an increase in read-out current.

Figure 8:
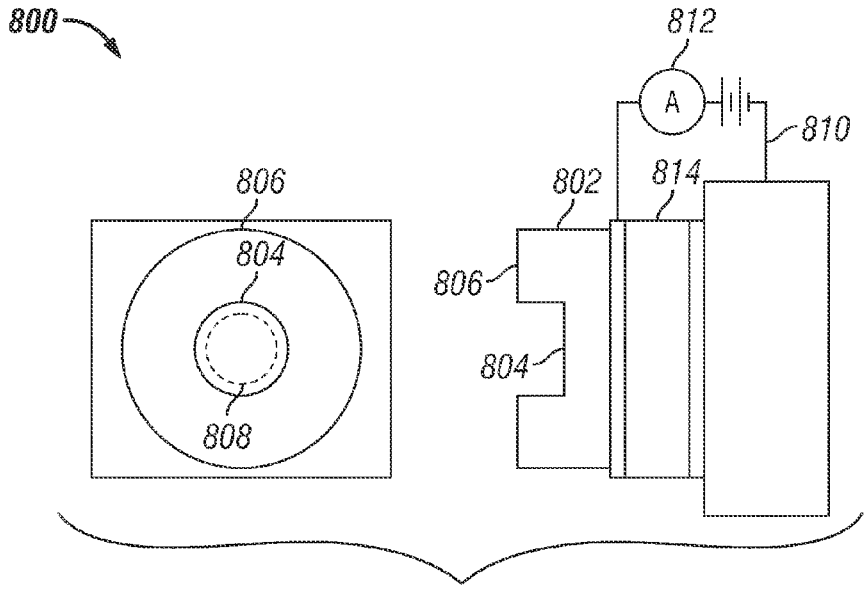
FIG. 8 shows another target that monitors spot profile size and position in accordance with one embodiment of the present disclosure.

FIG. 8 shows another target 800 that monitors beam spot profile size and position in accordance with one embodiment of the present disclosure. In the embodiment of FIG. 8, the target 800 includes a target layer 802 with a varying thickness to facilitate detection of a change in beam spot profile size and position. In FIG. 8, the target layer 802 includes a central portion 804 having a first thickness and a periphery portion 806 with a second thickness that is greater than the first thickness. In one specific embodiment, the central portion 804 and the periphery portion 806 can be arranged and sized so that the electron beam generates a spot profile 808 that appears only within the central portion 804 of the target layer 802. A measuring circuit 810 with an amp-meter 812 is coupled to a monitor layer 814. When the electron beam 808 strikes only the central portion 804 of the target, the read-out current at the amp-meter 812 for the monitor layer 814 has an initial value. If the spot profile 808 expands in size or shifts in position so that the electron beam impacts the periphery portion 806 of the target, then the read-out current decreases significantly because the beam is impacting a thicker portion of the target. In this manner, the measuring circuitry 810 can advantageously monitor beam spot profile size and position using a single amp-meter and a target layer with a varying thickness.

Figure 9:
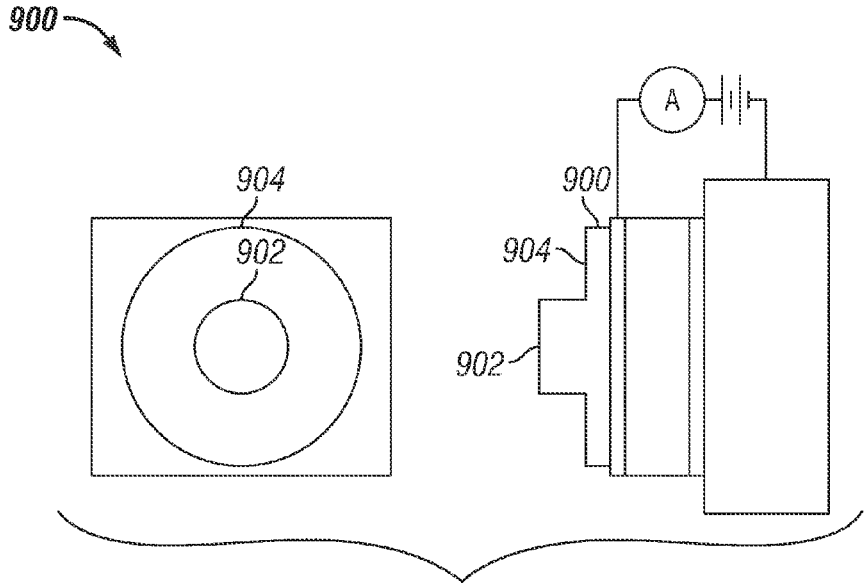
FIG. 9 shows a target layer with a varying thickness in accordance with one embodiment of the present disclosure.

FIG. 9 shows another target layer 900 with a varying thickness in accordance with one embodiment of the present disclosure. In this embodiment, the target layer 900 includes a central portion 902 having a first thickness and a periphery portion 904 with a second thickness that is substantially thinner than the first thickness. In contrast to the embodiment of FIG. 8, in this case, when a spot profile expands in size or shifts in position so that the electron beam impacts the periphery portion 904 of the target, then the read-out current increases significantly because the beam is impacting a thinner portion of the target.

Figure 10:
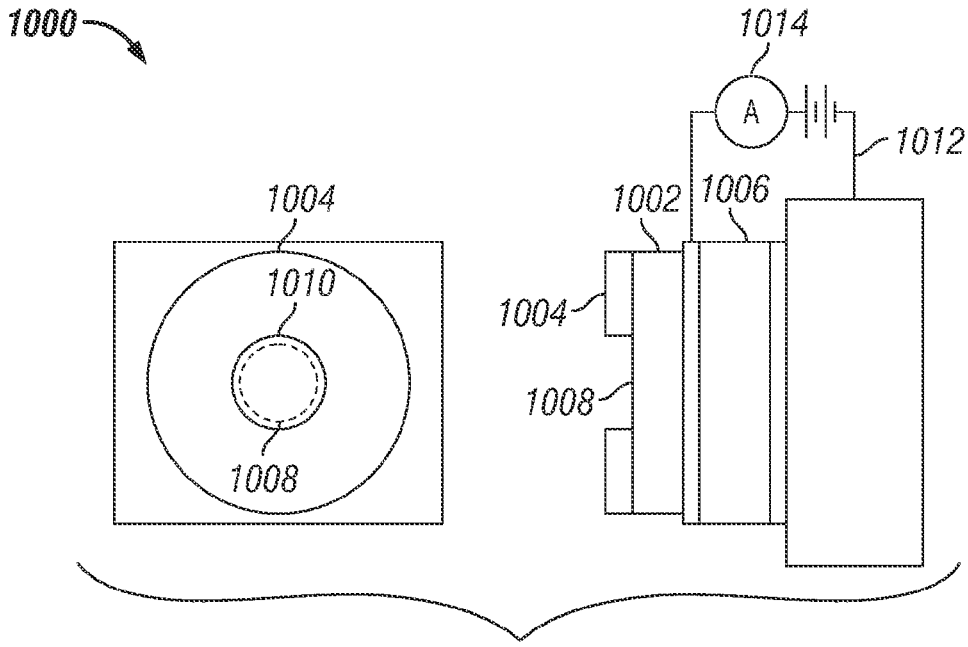
FIG. 10 shows yet another target that monitors spot profile size and position in accordance with one embodiment of the present disclosure.

FIG. 10 shows yet another target 1000 that monitors beam spot profile size and position in accordance with one embodiment of the present disclosure. The embodiment shown in FIG. 10 includes a target layer 1002 with a blocking layer 1004 to facilitate detection of a change in spot profile size and position. The blocking layer 1004 at least partially blocks electrons from entering the target layer 1002 and a monitor layer 1006. In various embodiments, the blocking layer 1004 is formed from, for example, lead, gold, platinum, and/or tungsten. In FIG. 10, the blocking layer 1004 covers a periphery portion of the target layer 1002, while a central portion 1008 of the target layer is exposed. In one specific embodiment, the central portion 1008 and the periphery portion can be arranged and sized so that the electron beam 1010 generates a spot profile that appears within the central portion 1008 of the target layer 1002. A measuring circuit 1012 with an amp-meter 1014 is coupled to the monitor layer 1006. When the electron beam strikes only the central portion 1008 of the target, the read-out current at the amp-meter 1014 for the monitor layer 1006 has an initial value. If the spot profile 1010 expands in size or shifts in position so that the electron beam impacts the blocking layer 1004, then the read-out current decreases significantly because the beam is impacting the blocking layer and fewer electrons are entering the monitor layer 1006. In this manner, the measuring circuitry 1012 can advantageously monitor beam spot profile size and position using a single amp-meter and a blocking layer.

Figure 11:
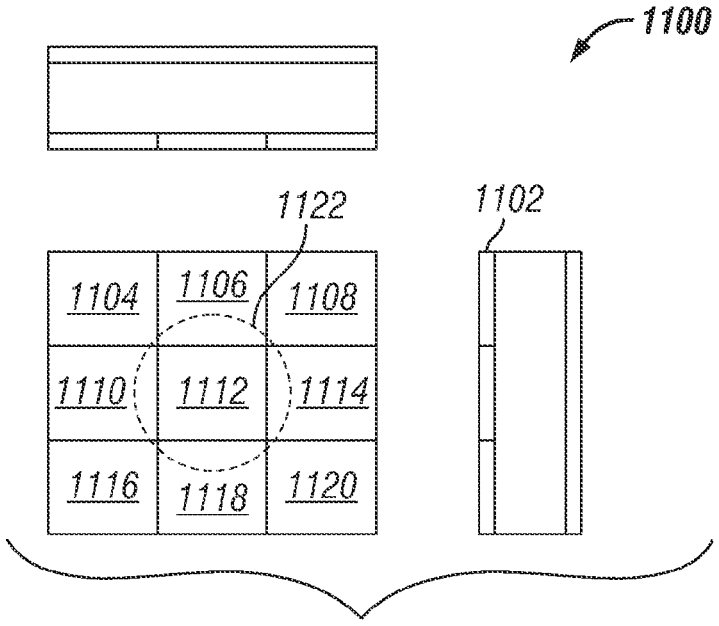
FIG. 11 shows another example of a target that monitors spot profile size and position in accordance with one embodiment of the present disclosure.

FIG. 11 shows another example of a target 1100 that monitors spot profile size and position in accordance with one embodiment of the present disclosure. In this embodiment, the target 1100 can monitor electron beam spot profile size and position, while also differentiating between a change in electron beam position and a change in spot profile size. The target 1100 includes a first conductive layer 1102 that is split into nine sections. The measuring circuitry includes nine amp-meters (not shown) that are electrically coupled to the nine sections 1104, 1106, 1108, 1110, 1112, 1114, 1116, 1118. 1120. The position and size of the spot profile is monitored by interpreting the read-out currents from the nine different sections.

In one specific embodiment, the nine sections can be arranged and sized so that the electron beam generates a spot profile 1122 that is concentric within or about a central section 1112. When the electron beam strikes the central section 1112 concentrically, then read-out current for the central section 1112 and for each periphery section 1108, 1110, 1114, 1116, 1118. 1120 have initial values. If the spot profile 1122 expands in size, then the read-out current decreases at the central section 1122, but increases proportionally at the periphery sections. If the spot profile 1122 decreases in size, then the read-out current increases at the central section 1112, but decreases proportionally at the periphery sections. A change in the position of the spot profile 1122 can also be detected by monitoring the read-out currents for the periphery sections. For example, if the beam spot profile 1122 shifts in a diagonal direction (e.g., North-East), then the read-out current in sections 1106, 1108, and 1114 will increase, while the read-out currents for sections 1110, 1116, and 1118 will decrease.

Figure 12:
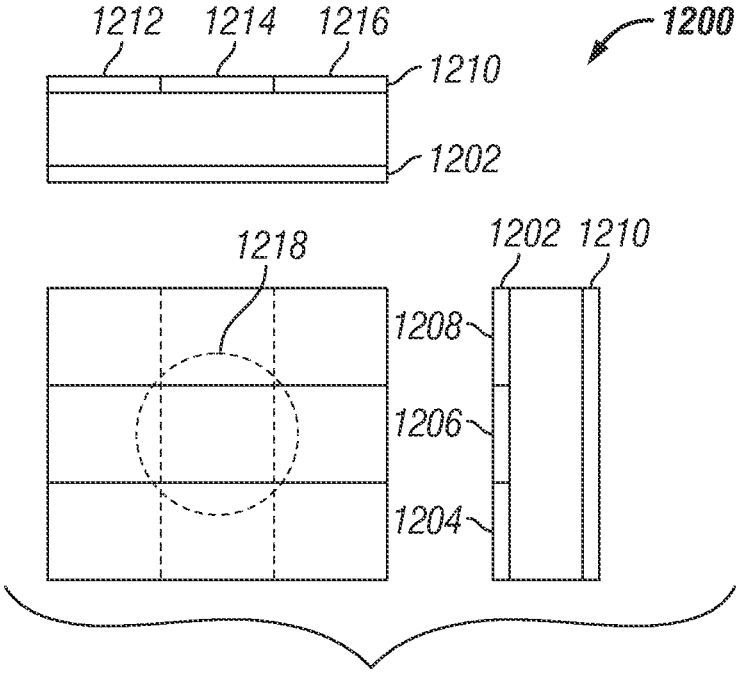
FIG. 12 shows yet another example of a target that monitors spot profile size and position in accordance with one embodiment of the present disclosure.

FIG. 12 shows yet another example of a target 1200 that monitors beam spot profile size and position in accordance with one embodiment of the present disclosure. In FIG. 12, a first conducting layer 1202 is split into three horizontal strips 1204, 1206, 1208, while a second conducting layer 1210 is split into three vertical strips 1212, 1214, 1216. In some embodiments, the measuring circuitry includes three amp-meters (not shown) that are electrically coupled to the six strips (e.g., first amp-meter couples central strips 1206 and 1214; second amp-meter couples peripheral strips 1208 and 1216; and third amp-meter couples peripheral strips 1204 and 1212). In such an embodiment, the target 1200 can monitor electron beam spot profile size and position, while also differentiating between a change in electron beam position and a change in spot profile size. For example, if a spot profile 1218 expands in size, then the read-out current decreases at the central strips 1206, 1214, but increases proportionally at periphery strips 1204, 1208, 1212, 1216. A change in the position of the spot profile 1218 can be detected by monitoring the read-out currents for the periphery strips. For example, if the beam spot profile shifts in a diagonal direction (e.g., North-East), then the read-out current in strips 1208 and 1216 will increase, while the read-out currents for strips 1204 and 1212 will decrease.

The embodiments presented in FIGS. 11 and 12 are illustrative examples. Various other embodiments may include more than the 3 strips and the 9 sections shown in FIGS. 11 and 12. For example, illustrative embodiments presented herein are directed to using sections and strips with widths that are less than 100 micrometers. In one example, MEMS technology can be used to generate the strips and sections. In one specific embodiment, a metallization layer is deposited on a monitor layer through a chemical vapor deposition process and then etchant is used to create many isolated sections or strips within metallization layer. In this manner, many isolated sections or strips can be generated (e.g., 10, 100, and 1000). The increased number of sections and strips will provide more detailed spot profile size information and position information.

Figure 13A:
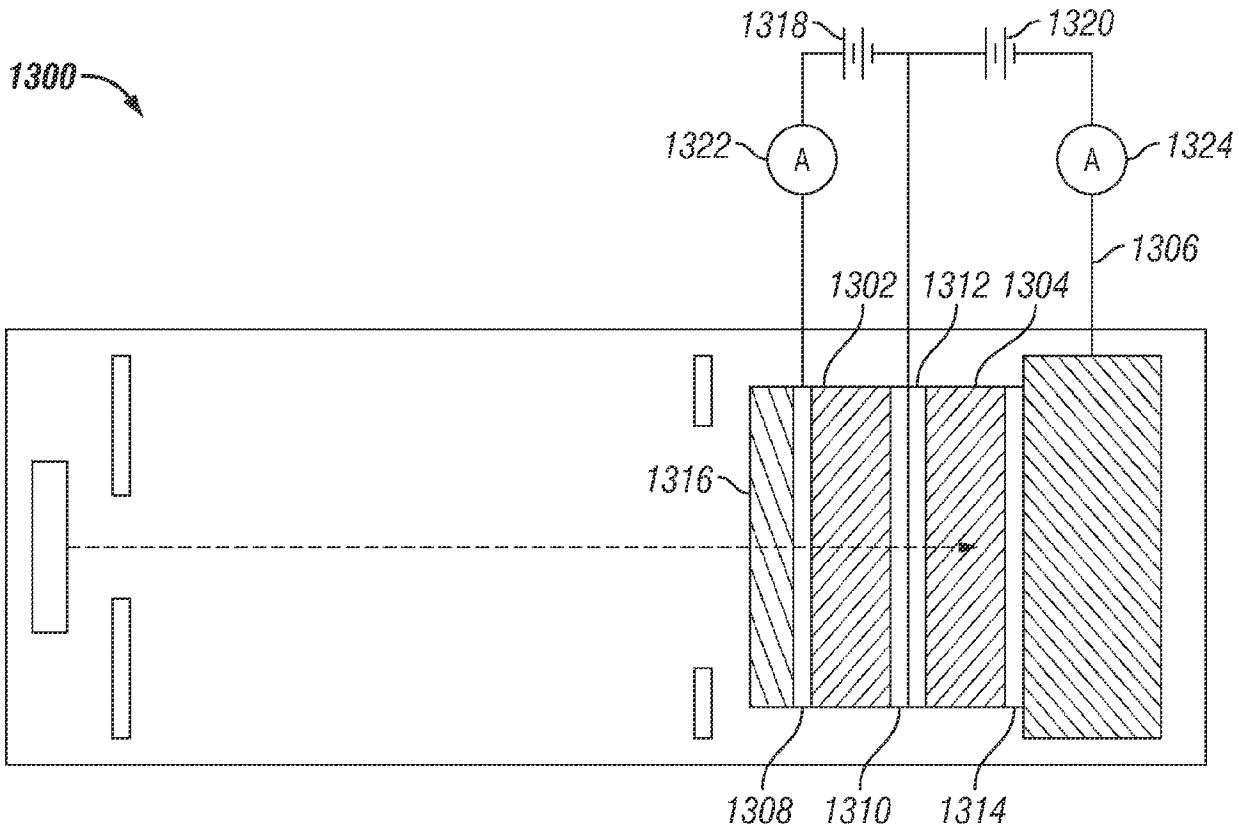
FIG. 13A shows a target with multiple monitor layers in accordance with one embodiment of the present disclosure.

Illustrative embodiments of the present disclosure are also directed to a target with a number of monitor layers. FIG. 13A shows a target 1300 with multiple monitor layers in accordance with one embodiment of the present disclosure. In the embodiment of FIG. 13A, the target 1300 includes a first monitor layer 1302 and a second monitor layer 1304. The second monitor layer 1304 is disposed adjacent to the first monitor layer 1302 so that electrons that pass through the first monitor layer enter the second monitor layer. The first monitor layer 1302 is coupled to measuring circuitry 1306 using a first conductive layer 1308 and a second conductive layer 1310, while the second monitor layer 1304 is coupled to the measuring circuitry using a third conductive layer 1312 and a fourth conductive layer 1314. In various embodiments, the second conductive layer 1310 and the third conductive layer 1312 are in physical contact with one another. In a further specific embodiment, the second conductive layer 1310 and the third conductive layer 1312 are a single conductive layer.

Such embodiments advantageously facilitate thermal conduction away from a target layer 1316 because the layers of the target 1300 are in thermal contact.

As shown in FIG. 13A, the first monitor layer 1302 and the second monitor layer 1304 are coupled to measuring circuitry 1306. In various embodiments, the measuring circuitry 1306 includes a first power supply 1318 to apply a voltage bias to the first monitor layer 1302 and a second power supply 1320 to apply a voltage bias to the second monitor layer 1304. The measuring circuitry 1306 also includes a first amp-meter 1322 for measuring current produced within the first monitor layer 1302 and a second amp-meter 1324 for measuring current produced within the second monitor layer 1324. The amp-meter 1324 is located between the power supply 1320 and a heat sink 1326.

Figure 13B:
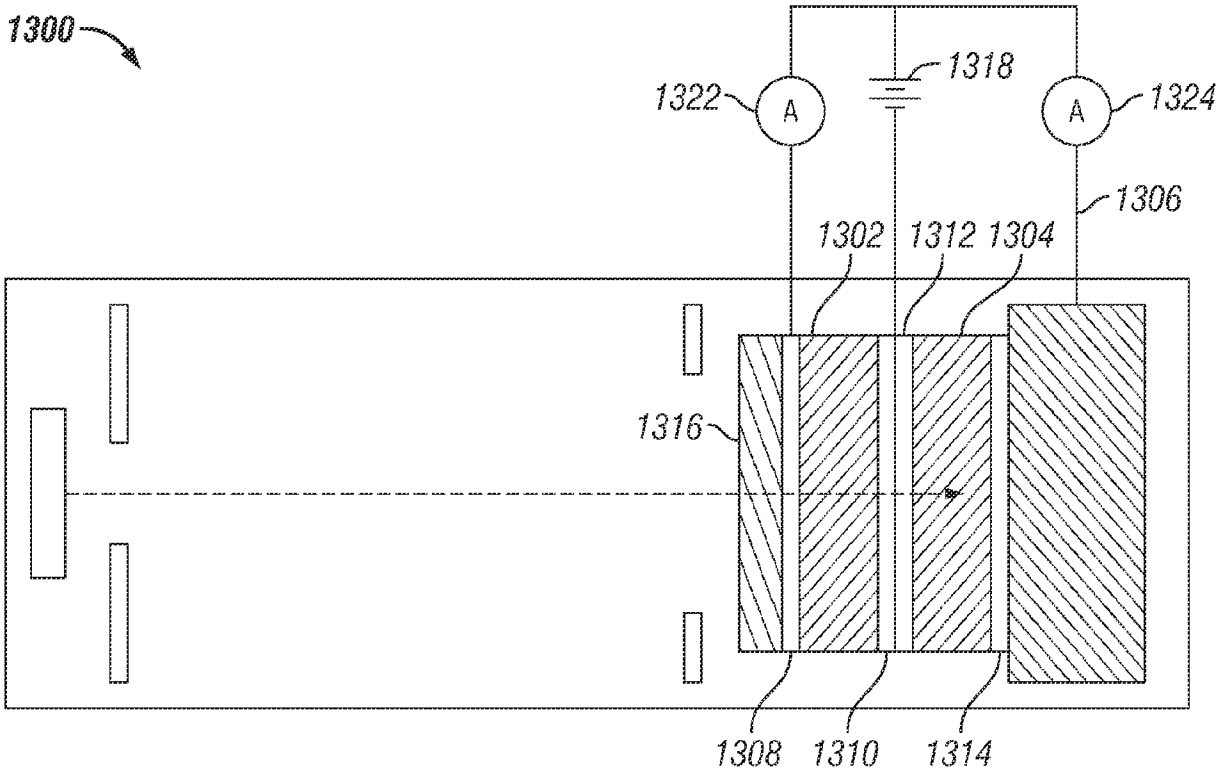
FIG. 13B shows a target with multiple monitor layers in accordance with another embodiment of the present disclosure.

Various other configurations for the measuring circuitry 1306 can also be used. For example, FIG. 13B shows an embodiment where a single power supply 1318 can be used to apply a voltage bias to both monitor layers 1302, 1304. Such an embodiment advantageously simplifies the measuring circuitry 1306.

In the embodiment shown in FIG. 13A, as electrons pass through the target layer 1316 and the first monitor layer 1302, the charges produced by electrons within the first monitor layer are measured by the first amp-meter 1322. In some embodiments, the target layer 1316 and the first monitor layer 1302 are configured (e.g., using layer thickness and layer material) so that at least some of the electrons also enter the second monitor layer 1304. The charges produced by those electrons within the second monitor layer 1304 are measured by the second amp-meter 1324. In various embodiments, the target 1316, the first monitor layer 1302, and the second monitor layer 1304 can also be configured to dissipate electron energy so that electrons are prevented from passing through the second monitor layer (e.g. prevented from penetrating the entire second monitor layer).

Exemplary embodiments of the present disclosure include two monitor layers only for illustrative purposes. Further embodiments of the present disclosure include more than two monitor layers (e.g., 3, 5, and 10 monitor layers).

Figure 14:
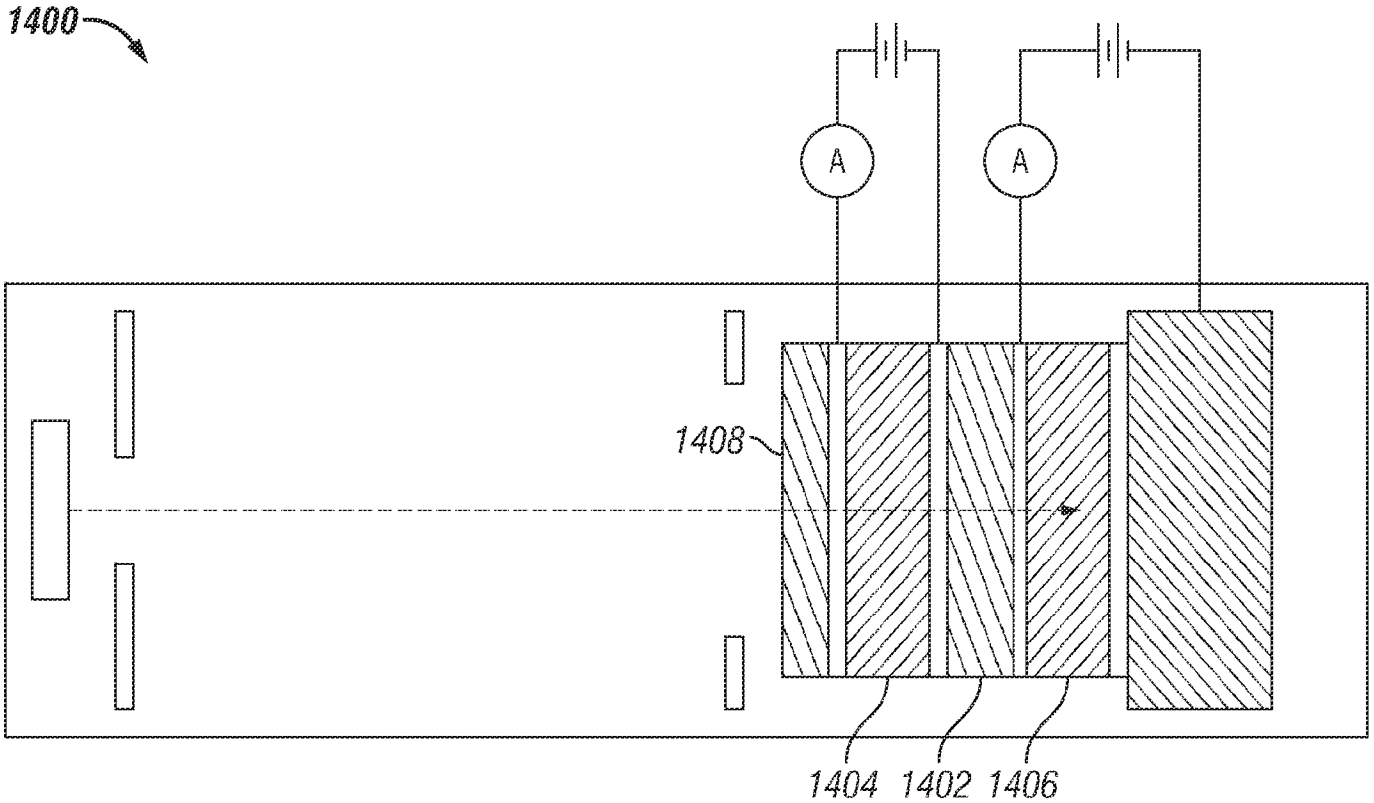
FIG. 14 shows a target with a damping layer in accordance with one embodiment of the present disclosure.

Illustrative embodiments of the present disclosure are also directed to a target with a damping layer. FIG. 14 shows a target 1400 with a damping layer 1402 in accordance with one embodiment of the present disclosure. In the embodiment of FIG. 14, the target 1400 includes a first monitor layer 1404 and a second monitor layer 1406. The damping layer 1402 is disposed between the first monitor layer 1404 and the second monitor layer 1406. The damping layer 1402 helps dissipate electron energy from electrons that have passed through a target layer 1408 and the first monitor layer 1404. As a result, the second monitor layer 1406 can be selected to have a smaller thickness because the electrons entering the second monitor layer will have less energy. The damping layer 1402 is particularly advantageous in embodiments where, after penetrating the target layer, the residual energy of the electron beam is still very high (e.g., 400 keV or more) and thick monitor layers would otherwise be used to prevent electrons from passing through the second monitor layer 1406.

In various embodiments, the thickness and/or the material of the damping layer 1402 are selected so that electrons below a particular energy level do not pass into the second monitor layer 1406 (e.g., electrons with an initial energy below 500 keV do not pass into the second monitor layer, while electrons above 500 keV do pass into the second monitor layer). In such an embodiment, if current is no longer detected at the second monitor layer 1406, this information indicates that the electron beam initial strength has fallen below 500 keV. In one example, the thickness of the damping layer 1402 is selected according to the plot shown in FIG. 2. The damping layer 1402 can be formed from a material such as gold, platinum, tungsten, or any conductive metal element with a high atomic Z number (e.g., for enhanced X-ray production and/or higher electron stopping power). The damping layer 1402 can also act as a secondary target layer. If electrons with sufficient energy enter the damping layer 1402, then X-rays can be generated at both the target layer 1408 and the damping layer.

Illustrative embodiments of the present disclosure also include a control unit for monitoring X-ray generation. In one embodiment, the control unit is a computer processor that is coupled to measuring circuitry. The control unit receives an output signal characterizing an electrical parameter from one or more meters within the measuring circuitry. In some embodiments, the control unit receives readout-currents from one or more amp-meters within the measuring circuitry. Based on the read-out currents, the control unit determines at least one characteristic of the X-rays generated by a target (e.g., number of X-rays and/or energy of X-rays). For example, the number of X-rays produced by a target is based upon characteristics of the electron beam. The characteristics of the electron beam include the electron beam energy ($E_\epsilon$) and also the electron beam current ($I_\epsilon$). Equation 1 below shows one example of a relationship between number of X-rays produced by the target, the electron beam current ($I_\epsilon$), and the electron beam energy ($E_\epsilon$):

$$\text{Number of x-rays} \propto I_\epsilon E_\epsilon^{\alpha} (2 \le \alpha \le 3) \tag{1}$$

The specific relationship between the generated X-rays, the electron beam energy ($E_\epsilon$), and the electron beam current ($I_\epsilon$) depends on the specific design and configuration of the X-ray generator. In particular, the relationship depends on the configuration of the target (e.g., thickness and composition materials). In one example, the specific relationship can be determined by striking the target with an electron beam of known beam energy and current and detecting the characteristics of the produced X-rays. In this manner, an X-ray generator can be calibrated. In additional or alternative embodiments, the specific relationship can be calculated as known in the Bremsstahlung production art.

In various embodiments of the present disclosure, the characteristics of the X-rays being generated by the target can be determined by monitoring at least one characteristic of the electron beam striking the target (e.g., electron beam energy ($E_\epsilon$) and/or electron beam current ($I_\epsilon$)). In various embodiments, the control unit determines the characteristic of the electron beam based upon a read-out current from the amp-meter. In one specific embodiment of the present disclosure, for a target with a single monitor layer, equation 2 below can be used to determine electron beam current ($I_\epsilon$), while equation 3 can be used to determine the electron beam energy ($E_\epsilon$):

$$I_\varepsilon = \frac{I_M}{\left[G_\varepsilon * \left(\frac{E_M}{13}\right) * \varepsilon_M\right]} \equiv \frac{I_M}{\left[G_\varepsilon * \left(\frac{E_\varepsilon - E_T}{13}\right) * \varepsilon_M\right]} \tag{2}$$

$$E_\varepsilon = \frac{I_M}{[G_\varepsilon * I_\varepsilon * \varepsilon_M]} * 13 + E_T \tag{3}$$

In equations 2 and 3, 13 eV is the energy required to create an electron-hole pair within a diamond monitor layer. This value may vary for monitor layers made of other materials. $I_M$ is the read-out current that is measured by the amp-meter and received by the control unit. $\epsilon_M$ is the charge collection efficiency for the monitor layer. The charge collection efficiency will depend on the configuration (e.g., thickness and material) of the monitor layer. For example, a single crystal diamond has nearly 100% charge collection efficiency. Other materials may have lower charge collection efficiencies. The charge collection efficiency of a material can be determined using an electron beam with known beam energy and current. $E_M$ is the electron energy loss within the monitor layer. Electron energy loss within the monitor layer will depend on the thickness and the material used for the monitor layer. $E_T$ is the electron loss within the target layer. Electron energy loss within the target layer will also depend on the thickness and the material used for the target layer. The electron energy loss in the target and monitor layers can be determined using an electron beam with known beam energy and current. Additionally or alternatively, the electron energy loss can be calculated as known in the art. For example, the electron energy loss can be calculated based on energy loss computation codes as disclosed in, for example, the reference: M. J. Berger, J. S. Coursey, M. A. Zucker and J. Chang, "Stopping-Power and Range Tables for Electrons, Protons, and Helium Ions," National Institute of Standards and Technology (accessible at http://www.nist.gov/pml/data/star/index.cfm) (hereinafter "the Berger reference"). In particular, the ESTAR, PSTAR, and ASTAR databases and range tables within the Berger reference can be used to calculate stopping-power for electrons, protons, or helium ions. Furthermore, in equations 2 and 3, $G_\epsilon$ is the kinematical factor of the beam spot size. $G_\epsilon$ has a value of $0<G_e\leq 1$. In cases where the beam spot profile is contained within an area of monitor layer, $G_e$ is equal to 1. Illustrative embodiments, such as the ones shown in FIGS. 4-12, can be used to determine whether the beam spot profile is contained within the area of the monitor layer.

In another embodiment of the present disclosure, the control unit determines at least one of the electron beam energy ($E_\epsilon$) and the electron beam current ($I_\epsilon$) for a target with at least two monitor layers. In one specific example, the control unit can determine electron beam energy ($E_\epsilon$) and the electron beam current ($I_\epsilon$) based upon equations 4 and 5 below. Equation 4 can be used to determine electron beam current ($I_\epsilon$), while equation 5 can be used to determine the electron beam energy ($E_\epsilon$):

$$I_\varepsilon = \frac{I_{M1}}{\left[G_\varepsilon * \left(\frac{E_{M1}}{13}\right) * \varepsilon_{M1}\right]}, \quad \text{or} \quad = \frac{I_{M2}}{\left[G_\varepsilon * \left(\frac{E_{M2}}{13}\right) * \varepsilon_{M2}\right]} \tag{4}$$

$$E_\varepsilon = \left[\frac{I_{M2}/I_{M1}}{\varepsilon_{M2}/\varepsilon_{M1}} + 1\right] * E_{M1} + E_T \cong [I_{M2}/I_{M1} + 1] * E_{M1} + E_T \tag{5}$$

In equations 4 and 5, $I_{M1}$ is the read-out current for the first monitor layer and $I_{M2}$ is the read-out current for the second monitor layer. $E_{M1}$ is the electron energy loss within the first monitor layer. The electron energy loss is a fixed-value for a given monitor layer configuration. As explained above, electron energy loss in the monitor layers can be calculated as known in the art (e.g., Berger reference) or can be determined using an electron beam with known beam energy and current. $E_{M2}$ is the electron energy loss within the second monitor layer, which, in various embodiments, is the remaining electron energy (e.g., $E_\epsilon - E_T - E_{M1}$).

As shown in equations 4 and 5, a target with two monitor layers can be advantageously used to determine electron beam energy ($E_\epsilon$) without using the kinematical factor of the beam spot size ($G_\epsilon$). Also, if the first monitor layer and the second monitor layer are formed from a similar material (e.g., both formed from diamond), then the electron beam energy ($E_\epsilon$) can be determined without using the charge collection efficiency for the monitor layers (e.g., $\epsilon_{M1}$ and $\epsilon_{M2}$). Furthermore, the electron beam energy ($E_\epsilon$) can be determined without using the electron beam current ($I_\epsilon$), or vice versa. In this manner, some embodiment of the present disclosure can advantageously determine beam energy ($E_\epsilon$) information independent of beam current ($I_\epsilon$), beam spot profile size ($G_\epsilon$), and charge collection efficiencies(e.g., $\epsilon_{M1}$ and $\epsilon_{M2}$).

In another embodiment, the control unit determines at least one of the electron beam energy ($E_\epsilon$) and the electron beam current ($I_\epsilon$) for a target with at least two layers and a damping layer located between the monitor layers. In one example, the control unit can determine electron beam energy ($E_\epsilon$) and the electron beam current ($I_\epsilon$) based upon equations 6 and 7 below:

$$I_\varepsilon = \frac{I_{M1}}{\left[G_\varepsilon * \left(\frac{E_{M1}}{13}\right) * \varepsilon_{M1}\right]}, \quad \text{or} \quad = \frac{I_{M2}}{\left[G_\varepsilon * \left(\frac{E_{M2}}{13}\right) * \varepsilon_{M2}\right]} \tag{6}$$

$$E_\varepsilon = \left[\frac{I_{M2}/I_{M1}}{\varepsilon_{M2}/\varepsilon_{M1}} + 1\right] * E_{M1} + E_T + E_D \cong [I_{M2}/I_{M1} + 1] * E_{M1} + E_T + E_D \tag{7}$$

In equations 6 and 7, $I_{M1}$ is the read-out current for the first monitor layer and $I_{M2}$ is the read-out current for the second monitor layer. $E_D$ is the electron energy loss within the damping layer. Electron energy loss within the damping layer is a fixed value that depends on the thickness and the material used for the damping layer. The electron energy loss in the damping layers can be calculated as known in the art (e.g., the Berger reference) or can be determined using an electron beam with known beam energy and current. $E_{M2}$ is the electron energy loss within the second monitor layer, which, in various embodiments, is the remaining electron energy (e.g., $E_\epsilon - E_T - E_{M1} - E_D$).

In various embodiments of the present disclosure, the control unit monitors X-ray generation by receiving an output signal characterizing an electrical parameter of the monitor layer (e.g., charge, current, voltage, resistance, or impedance) and interpreting that electrical parameter. In one embodiment, the control unit receives an output signal characterizing current generated within at least one monitor layer (e.g., read-out current). The control unit determines the electron beam energy ($E_\epsilon$) and/or and the electron beam current ($I_\epsilon$) based upon the read-out current (e.g., using equations 2-7). In some embodiments, the control unit uses the electron beam energy ($E_\epsilon$) and/or the electron beam current ($I_\epsilon$) to determine a characteristic of the X-ray generation. In one illustrative embodiment, the control unit monitors X-ray generation by establishing that electron beam energy ($E_\epsilon$) and/or and the electron beam current ($I_\epsilon$) fall within predetermined acceptable ranges.

In further illustrative embodiments, the control unit modulates performance of the X-ray generator based upon the electrical parameter received from one or more monitor layers. To this end, the control unit is in electrical communication with the electron source and/or the accelerator section of the X-ray generator. For example, if the control unit determines that the electron energy ($E_\epsilon$) or electron beam current ($I_\epsilon$) are above a predetermined acceptable range, then the control unit may stop operation by switching off power to the electron source and/or the accelerator section to prevent overheating of the target.

In additional or alternative embodiments, the control unit modulates a power parameter (e.g., current, voltage, and power) of an electron source based upon the electrical parameter received from one or more monitor layers. In such an illustrative embodiment, the control unit is in electrical communication with the control circuitry of the electron source. In one example, if the control unit determines that the electron beam current ($I_\epsilon$) is below a predetermined acceptable range, then the control unit may send instructions to the control circuitry to increase the voltage applied to the electron source. In turn, the increase in voltage will cause the electron source to produce more electrons and increase the electron beam current.

In further illustrative embodiments, the control unit modulates a power parameter (e.g., current, voltage, and power) of an accelerator section based upon the electrical parameter received from one or more monitor layers. In such an illustrative embodiment, the control unit is in electrical communication with the power circuitry of the accelerator section. In one example, if the control unit determines that the electron beam energy ($E_\epsilon$) is below a predetermined acceptable range (e.g., 200 keV to 500 keV), then the control unit may send instructions to the power circuitry to increase the voltage to the accelerator section. The increase in voltage may cause an increase in potential between two or more grids within the accelerator section. In turn, this increase in potential may increase the electron beam energy.

Various embodiments of the present disclosure are also directed to a control unit that monitors X-ray generation by monitoring the position and/or the size of an electron beam spot profile. In accordance with exemplary embodiments of the present disclosure, targets such as the ones shown in FIGS. 4-12 can be used to monitor the position and/or size of an electron beam spot profile. In one specific embodiment, the control unit monitors X-ray generation by establishing that the spot profile size is within a predetermined acceptable range (e.g., 1 $mm^2$ to 1 $cm^2$). In an additional or alternative embodiment, the control unit monitors X-ray generation by establishing that the spot profile size is centered and/or contained within a specific area of a monitor layer. In a further illustrative embodiment, the control unit modulates performance of the X-ray generator based upon the position and/or the size of the electron beam spot profile. In one example, if the control unit determines that the electron beam spot profile is off-center, then the control unit may send instructions to the accelerator section to adjust a position of a grid or collimator inside the accelerator section. In another example, if the control unit determines that the electron beam spot profile size is greater than a predetermined limit, then the control unit may send instructions to the accelerator section to adjust a size of a collimator inside the accelerator section.

In another illustrative embodiment, the control unit monitors X-ray generation by monitoring a time structure of the electron beam. For example, in some cases, the X-ray generator may function in a pulsed mode of operation. The length of each pulse may be within the range of 0.1 μs to 100 μs, and the time between each pulse may be within the range of 1 μs to 100 ms. In various embodiments, the control unit can be used to monitor quality of the pulse mode of operation. In one specific example, the control unit measures a waveform for the pulsed mode of operation and establishes that the waveform corresponds to a square waveform (e.g., proper pulse length, proper pulse amplitude, proper time between pulses, and proper edge steepness).

Figure 15:
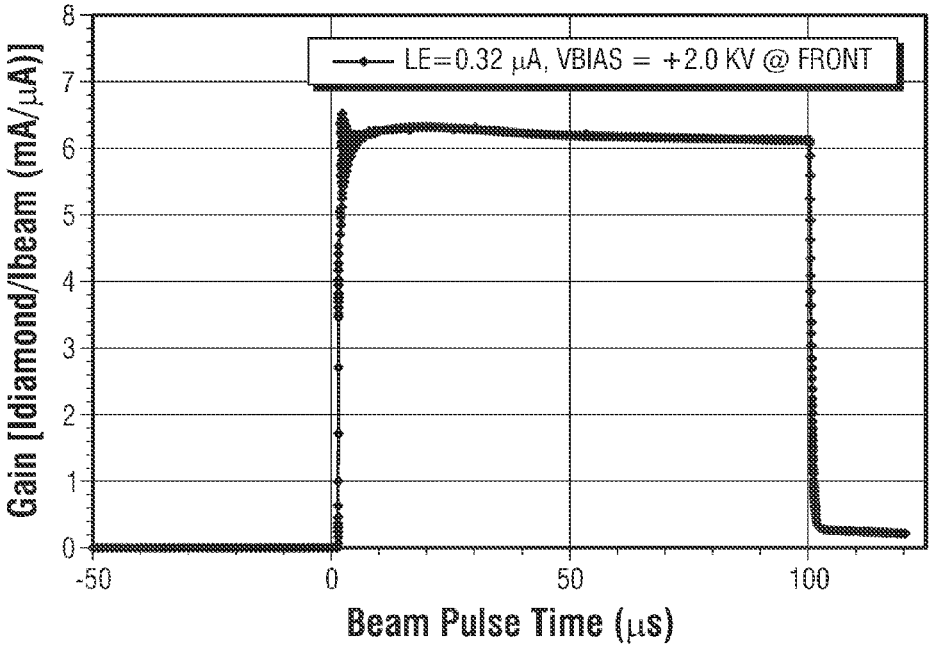
FIG. 15 shows a plot of a measured square waveform in accordance with one embodiment of the present disclosure.

FIG. 15 shows a plot of a measured square waveform in accordance with one embodiment of the present disclosure. The plot was produced using a pulsed 100 keV electron beam with a pulse width of 100 μs and a peak current a 0.32 μA. A voltage bias of +2.0 kV was applied to a diamond monitor layer (e.g., electrons were collected on the front-side of the monitor layer and "holes" were collected on the back-side of the monitor layer). The axes of the plot are gain versus beam pulse time. In this case, gain is the ratio of current generated within the monitor layer and current of the electron beam. The current within the diamond monitor layer was measured by an amp-meter coupled to the monitor layer. The electron beam current was separately measured. In theory, without a target layer in front of a diamond monitor layer, the maximum gain of the diamond monitor layer is about 7690 (e.g., 100 keV/13 eV). In the present case, the gain is about 6500, which is quite high and reasonably close to the theoretical maximum. There are several reasons why the measured gain is smaller than the theoretical gain. For example, in various embodiments, the conductive layer in front of the diamond layer has a finite thickness that reduces the electron beam energy. This effect can be diminished by decreasing the thickness of the conductive layer and by using metal elements with a low Z number as the conducting layer. Also, in some cases, many electrons within the electron beam do not enter the monitor layer (e.g., the electrons miss the target). To prevent this, in various embodiments, the area of the diamond layer is increased to ensure that most of the electrons from the electron beam enter the monitor layer. Additionally or alternatively, the accelerator section can be used to ensure that the electron beam is focused on the monitor layer. Another reason why the measured gain is smaller than the theoretical maximum is because electrons and holes have a finite lifetime (e.g., about 20 to 35 ns). This finite lifetime results in charge losses during transit time (e.g., about 3-5 ns) across the thickness of the diamond monitor layer (e.g., about 500 μm) before collection by the measuring circuitry. In various embodiments, the thickness of the monitor layer can be reduced to produce a gain that is closer to the theoretical maximum value.

Figure 16:
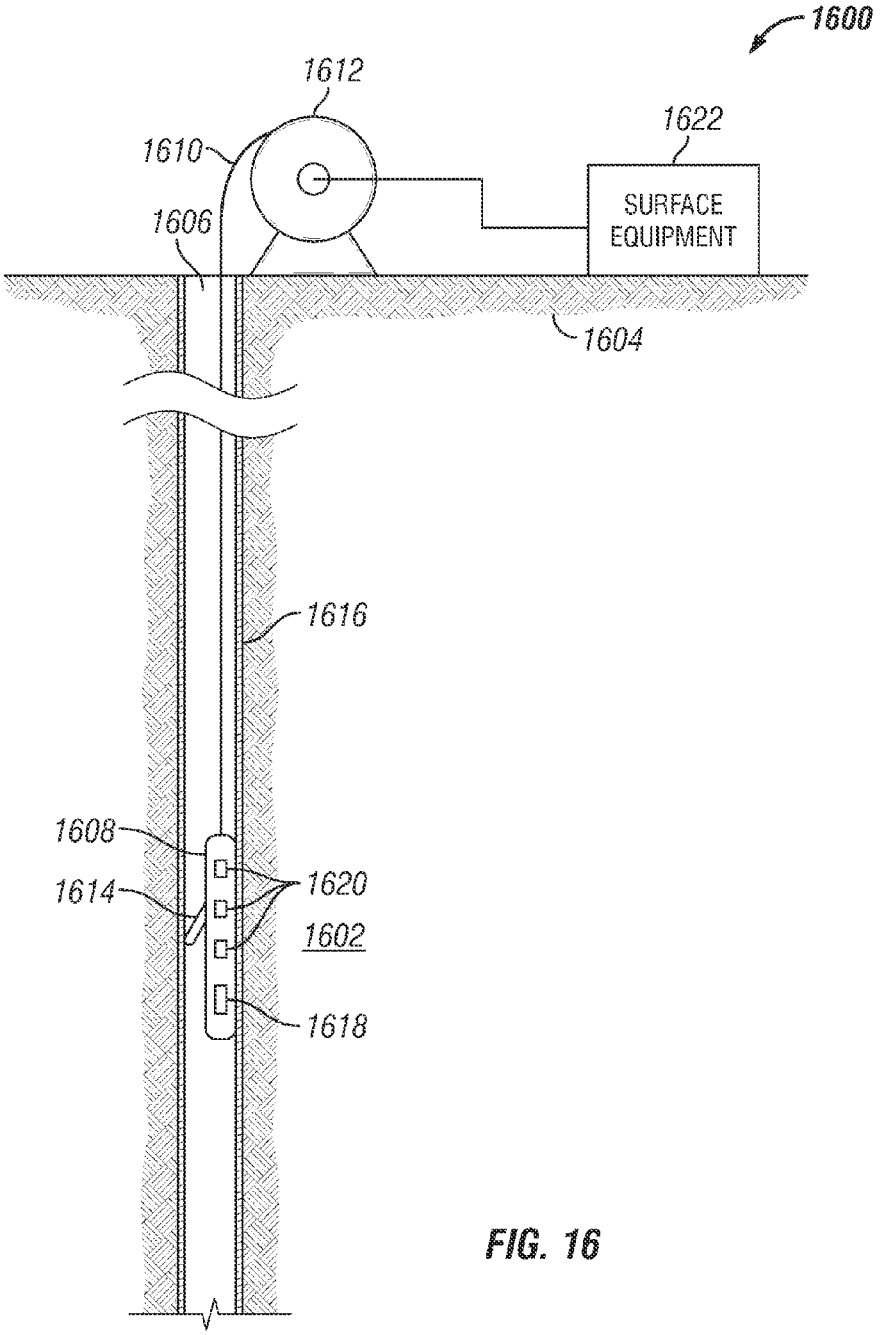
FIG. 16 shows a wireline system for evaluating a substance in accordance with one embodiment of the present disclosure.

Illustrative embodiments of the present disclosure are directed to oil and gas field applications. FIG. 16 shows a wireline system 1600 for evaluating a substance 1602 in accordance with one embodiment of the present disclosure. The wireline system 1600 is used to investigate, in situ, a substance 1602 within an earth formation 1604 surrounding a borehole 1606 to determine a characteristic of the substance (e.g., characteristics of solids and liquids within the formation). As shown in FIG. 16, the wireline tool 1608 is disposed within the borehole 1606 and suspended on an armored cable 1610. A length of the cable 1610 determines the depth of the wireline tool 1608 within the borehole 1606. The length of cable is controlled by a mechanism at the surface, such as a drum and winch system 1612. In some embodiments, a retractable arm 1614 is used to press the wireline tool 1608 against a borehole wall 1616.

As shown in FIG. 16, the wireline tool 1608 includes an X-ray generator 1618. In accordance with exemplary embodiments of the present disclosure, the X-ray generator includes a target that incorporates a monitor layer, such as the X-ray generators shown in FIGS. 1 and 4-14. The wireline tool 1608 also includes at least one X-ray detector 1620. The embodiment shown in FIG. 16 includes three X-ray detectors 1620. The wireline system 1600 includes surface equipment 1622 for supporting the wireline tool 1608 within the borehole 1606. In various embodiments, the surface equipment 1622 includes a power supply for providing electrical power to the wireline tool 1600. The surface equipment 1622 also includes an operator interface for communicating with the X-ray generator and the X-ray detectors. In some embodiments, the wireline tool 1608 and operator interface communicate through the armored cable 1610. Furthermore, although the wireline tool 1608 is shown as a single body in FIG. 16, the tool may alternatively include separate bodies.

Figure 17:
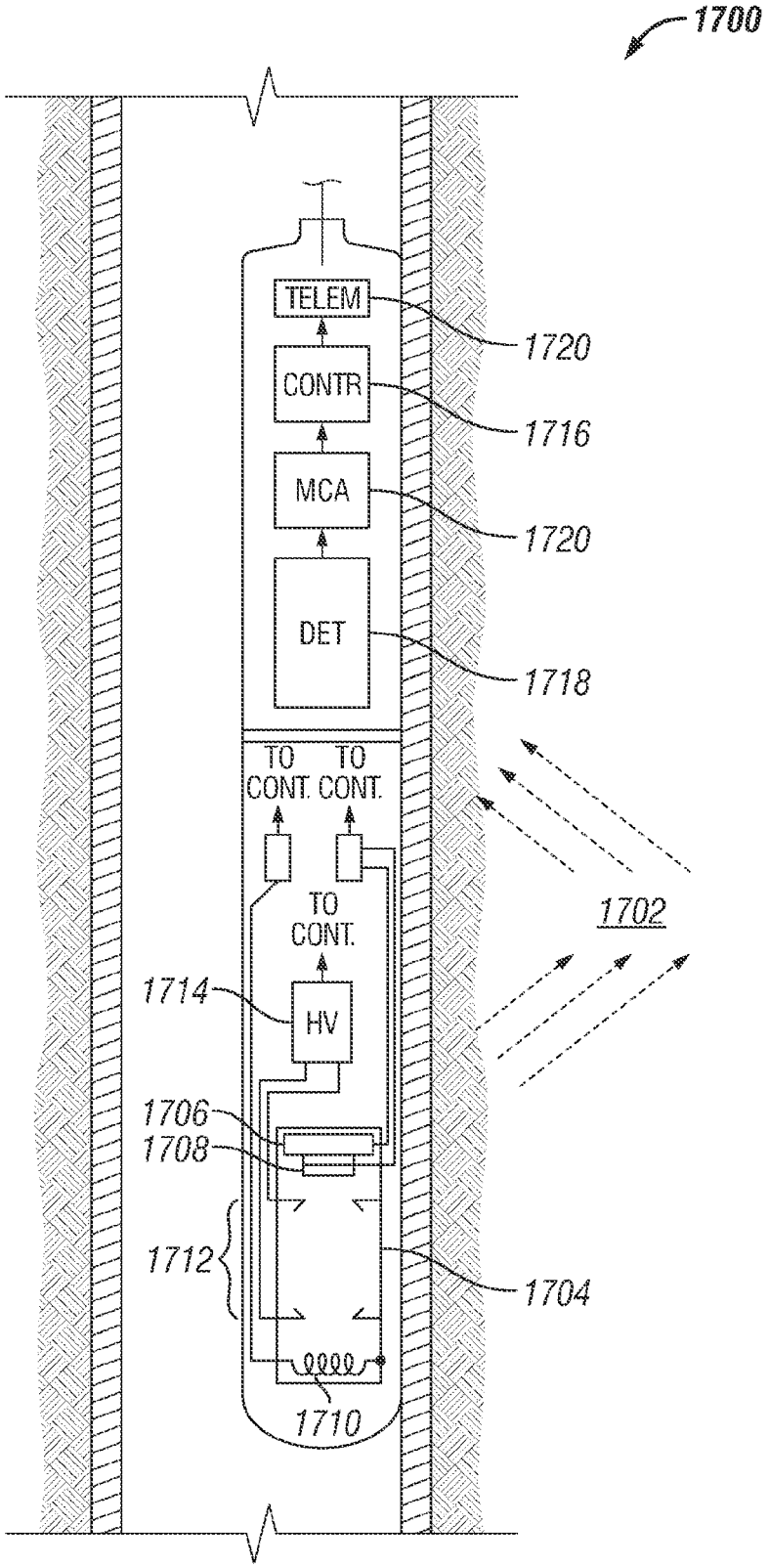
FIG. 17 shows a wireline tool for evaluating a substance in accordance with one embodiment of the present disclosure.

FIG. 17 shows a wireline tool 1700 for evaluating a substance (e.g., formation 1702) in accordance with one embodiment of the present disclosure. The wireline tool 1700 includes an X-ray generator 1704. In accordance with exemplary embodiments of the present disclosure, the X-ray generator 1704 includes a target 1706 that incorporates a monitor layer 1708, such as the X-ray generators shown in FIGS. 1 and 4-14. The X-ray generator 1704 also includes an electron source 1710 (e.g., filament) and an accelerator section 1712 with two grids that are coupled to power circuitry 1714 (e.g., high voltage power source). The target 1706, the power circuitry 1714, and the electron source 1710 are coupled to a control unit 1716. As explained above, the X-ray generator 1704 generates X-rays by impacting electrons against the target 1706. At least some of those X-rays enter the formation 1702 adjacent the wireline tool 1700. The X-rays are then scattered by the formation 1702.

The wireline tool 1700 also includes at least one X-ray detector 1718 for detecting X-rays that are scattered by the formation 1702. The parameters of the detected X-rays (e.g., count rate and amplitude) can be used to determine characteristics of the formation (e.g., density, porosity, and/or photo-electric effect). In the exemplary embodiment shown in FIG. 17, the X-ray detector 1718 uses a scintillator material to detect X-rays. When X-rays strike the scintillator material, the material produces light with intensity proportional to the energy of the X-ray. The X-ray detector also includes a photon detector (not shown) that detects the light and produces an output signal characterizing the detected X-rays (e.g., a photo multiplier tube (PMT)). The output signal is then provided to a multichannel analyzer (MCA) 1720 so that the detected X-rays with different energies are counted. The counting rate and the detector X-ray energy information can be used for evaluation of the formation 1702. In some embodiments, the MCA 1720 may also count the detected X-rays as a function of time. The MCA 1720 is electrically coupled to the control unit 1716 and provides the control unit with a signal characterizing the detected X-rays. The control unit 1716 may also be coupled to a telemetry module 1720 so that the wireline tool 1700 can communicate with surface equipment.

In illustrative embodiments, the control unit may either modulate or normalize the output signal characterizing the detected X-rays (e.g., the detector counting rates from MCA) based upon the output signal characterizing an electrical parameter within a monitor layer or monitor layers (e.g., the X-ray flux from the generator). In various embodiments, the control unit may normalize the output signal characterizing the detected X-rays based upon X-ray generation. For example, if the control unit determines that X-ray generation has dropped off by 10% (e.g., because the electron energy ($E_\epsilon$) and/or electron beam current ($I_\epsilon$) has decreased), then the control unit may also normalize the output signal characterizing the detected X-rays by 10%. The normalized output signal provides a more accurate measure of the properties of the formation.

In further illustrative embodiments, the control unit modulates performance of the X-ray generator based upon the output signal characterizing the detected X-rays (e.g., the output signal characterizing an electrical parameter within a monitor layer or monitor layers). For example, some scintillator detectors perform optimally at a particular counting rate (e.g., the accuracy in determining formation properties is high when the scintillator detectors are kept at constant counting rates). The control unit may include a feedback loop that modulates at least one of electron energy ($E_\epsilon$) or electron beam current ($I_\epsilon$) so that the scattered X-rays detected at the detectors produce a particular counting rate (e.g., maintain a constant counting rate). Furthermore, in some embodiments, the control unit normalizes the output signal characterizing the detected X-rays based upon based upon X-ray generation (e.g., the electron energy ($E_\epsilon$) and/or electron beam current ($I_\epsilon$)). In this manner, the control unit can produce and maintain a particular counting rate at the X-ray detector, while also generating a normalized output signal that provides a more accurate measure of the properties of the formation.

Illustrative embodiments of the present disclosure are not limited to wireline systems. Various embodiments of the present disclosure may also be applied in logging-while-drilling (LWD) systems, or any system where an X-ray generator is used to provide X-rays for measurements or imaging, such as a surface flowmeter system at a producing well site. Furthermore, illustrative embodiments of the present disclosure are not limited to oil and gas field applications. Various embodiments of the present disclosure may also be applied in fields such as mining, medical applications, non-invasive X-ray interrogation systems, or any system where an X-ray generator is used to provide X-rays for measurements or imaging.

Although several example embodiments have been described in detail above, those skilled in the art will readily appreciate that many modifications are possible in the example embodiments without materially departing from the scope of this disclosure. Accordingly, all such modifications are intended to be included within the scope of this disclosure.

What is claimed is:

1. A target for generating X-rays, the target comprising:

a target layer configured to generate X-rays when electron beam electrons enter the target layer, the target layer having a thickness selected so that at least some electron beam electrons pass through the target layer;

a first conductive layer electrically coupled to the at least one monitor layer;

a second conductive layer electrically coupled to the at least one monitor layer;

a power supply configured to provide a voltage bias between the first conductive layer and the second conductive layer; and at least one monitor layer disposed between the first conductive layer and the second conductive layer and adjacent to the target layer so that at least some of the electron beam electrons that pass through the target layer enter the at least one monitor layer, the at least one monitor layer being configured such that the electron beam electrons that enter the at least one monitor layer produce secondary ionization charges with secondary electrons and holes that, in the presence of the voltage bias between the first conductive layer and the second conductive layer, produce a measurable current in the monitor layer.

2. The target according to claim 1, further comprising:

a first conductive layer and a second conductive layer electrically coupled to the at least one monitor layer.

3. The target according to claim 2, further comprising:

a meter electrically coupled to the first conductive layer and the second conductive layer and configured to (1)

measure at least one electric parameter produced by electron beam electrons entering the at least one monitor layer and (2) generate an output signal representative of the electric parameter.

4. The target according to claim 1, wherein the at least one monitor layer comprises:

a first monitor layer disposed adjacent to the target layer so that at least some of the electron beam electrons that pass through the target layer enter the first monitor layer; and a second monitor layer disposed adjacent to the first monitor layer so that electron beam electrons that pass through the first monitor layer enter the second monitor layer.

5. The target according to claim 4, wherein the at least one monitor layer includes more than two monitor layers.

6. The target according to claim 4, further comprising:

a damping layer disposed between the first monitor layer and the second monitor layer.

7. The target according to claim 1, further comprising:

a blocking layer disposed adjacent to the target layer.

8. The target according to claim 1, wherein the target layer has a varying thickness.

9. The target according to claim 2, wherein at least one of the first conductive layer and the second conductive layer include a plurality of sections.

10. The device according to claim 1, wherein the thickness of the at least one monitor layer is selected to dissipate electron energy so that electron beam electrons are prevented from passing through the at least one monitor layer.

11. The device according to claim 1, wherein the target layer is selected from at least one of gold, tungsten, or platinum.

12. The device according to claim 1, wherein the at least one monitor layer is composed of a solid-state material.

13. The device according to claim 12, wherein the at least one monitor layer is composed of single crystal diamond.

14. A device comprising:

an electron source configured to generate electrons;

an accelerator section configured to generate an electron beam comprised of electron beam electrons; and a target comprising:

a target layer configured to generate X-rays when the electron beam electrons enter the target layer, the target layer having a thickness selected so that at least some electron beam electrons pass through the target layer;

a first conductive layer electrically coupled to the at least one monitor layer;

a second conductive layer electrically coupled to the at least one monitor layer;

a power supply configured to provide a voltage bias between the first conductive layer and the second conductive layer; and at least one monitor layer disposed between the first conductive layer and the second conductive layer and adjacent to the target layer so that at least some of the electron beam electrons that pass through the target layer enter the at least one monitor layer, the at least one monitor layer being configured such that the electron beam electrons that enter the at least one monitor layer produce secondary ionization charges with secondary electrons and holes that, in the presence of the voltage bias between the first conductive layer and the second conductive layer, produce a measurable current in the monitor layer.

15. The device according to claim 14, further comprising:

a meter electrically coupled to the at least one monitor layer and configured to (1) measure at least one electrical parameter produced by electron beam electrons entering the at least one monitor layer and (2) generate an output signal characterizing the electrical parameter.

16. The device according to claim 15, further comprising:

a processor electrically coupled to the meter and configured to (1) receive the output signal characterizing the electrical parameter of the at least one monitor layer and (2) determine at least one characteristic of the electron beam based upon the output signal.

17. The device according to claim 16, wherein at least one characteristic of the electron beam is at least one of an electron beam current, an electron beam energy, an electron beam spot profile size, or an electron beam spot profile position.

18. The device according to claim 14, wherein the at least one monitor layer comprises:

a first monitor layer disposed adjacent to the target layer so that at least some of the electron beam electrons that pass through the target layer enter the first monitor layer; and a second monitor layer disposed adjacent to the first monitor layer so that electron beam electrons that pass through the first monitor layer enter the second monitor layer.

19. The device according to claim 18, further comprising:

a damping layer disposed between the first monitor layer and the second monitor layer.

20. The device according to claim 18, further comprising:

a first meter electrically coupled to the first monitor layer and configured to (1) measure at least one electrical parameter produced by electron beam electrons entering the first monitor layer and (2) generate a first output signal characterizing the electrical parameter; and a second meter electrically coupled to the second monitor layer and configured to (1) measure at least one electrical parameter produced by electron beam electrons entering the second monitor layer and (2) generate an output signal characterizing the electrical parameter.

21. The device according to claim 20, further comprising:

a processor electrically coupled to the meter and configured to (1) receive the first output signal and the second output signal and (2) determine at least one characteristic of the electron beam based upon the first output signal and the second output signal.

22. The device according to claim 15, further comprising:

a control unit electrically coupled to the meter and configured to (1) receive the output signal characterizing the electrical parameter of the first monitor layer and (2) modulate performance of the X-ray generator based upon the output signal characterizing the electrical parameter.

23. The device according to claim 15, wherein the device is configured to evaluate a substance, the device further comprising:

at least one X-ray detector configured to (1) detect X-rays that pass through the substance and (2) generate an output signal characterizing the detected X-rays; and a control unit electrically coupled to the meter and the at least one X-ray detector, the control unit configured to (1) receive the output signal characterizing the electrical parameter of the at least one monitor layer and (2) normalize the output signal characterizing the detected X-rays based upon the output signal characterizing the electrical parameter of the at least one monitor layer.

24. The device according to claim 15, wherein the device is configured to evaluate a substance, the device further comprising:

at least one X-ray detector configured to (1) detect X-rays that pass through the substance and (2) generate an output signal characterizing the detected X-rays; and a control unit electrically coupled to the meter and the at least one X-ray detector, the control unit configured to (1) receive the output signal characterizing the detected X-rays, (2) modulate performance of the X-ray generator based upon the output signal characterizing the detected X-rays, and (3) normalize the output signal characterizing the detected X-rays based upon the output signal characterizing the electrical parameter of the at least one monitor layer.

25. A method for monitoring X-ray generation, the method comprising:

generating electrons;

applying a voltage bias between a first conductor and a second conductor;

accelerating the electrons towards a target to generate X-rays, wherein at least some of the accelerated electrons pass through the target and enter a monitor disposed between the first conductive layer and the second conductive layer, the accelerated electrons entering the monitor producing secondary ionization charges with secondary electrons and holes that, in the presence of the voltage bias between the first conductive layer and the second conductive layer, produce a current in the monitor; and measuring an electric parameter produced by the electrons within the monitor and generating an output signal characterizing the electric parameter.

* * * * *